US005526271A

United States Patent [19]

Abumehdi

[11] Patent Number: 5,526,271

[45] Date of Patent: Jun. 11, 1996

[54] FRANKING MACHINE

[75] Inventor: Cyrus Abumehdi, Harlow, United Kingdom

[73] Assignee: Neopost Limited, Essex, United Kingdom

[21] Appl. No.: 379,972

[22] Filed: Jan. 27, 1995

[30] Foreign Application Priority Data

Jan. 31, 1994 [GB] United Kingdom ..... 9401789

[51] Int. Cl.[6] ..... G07B 17/00

[52] U.S. Cl. ..... 364/464.02

[58] Field of Search ..... 364/464.02, 464.03

[56] References Cited

U.S. PATENT DOCUMENTS

| | | | |
|---|---|---|---|
| Re. 31,875 | 4/1985 | Check, Jr. et al. | 364/464.02 |
| 4,471,441 | 9/1984 | Check, Jr. | 364/464.02 |
| 4,524,426 | 6/1985 | Eckert et al. | 364/464.02 |
| 4,549,281 | 10/1985 | Eckert et al. | 364/464.02 |
| 4,631,681 | 12/1986 | Salazar et al. | 364/464.02 |
| 4,742,469 | 5/1988 | Haines et al. | 364/466 |
| 4,813,912 | 3/1989 | Chickneas et al. | 364/464.02 |
| 4,831,554 | 5/1989 | Storace et al. | 364/464.02 X |
| 4,907,271 | 3/1990 | Gilham | 380/25 |
| 5,058,025 | 10/1991 | Haines et al. | 364/464.02 |
| 5,077,792 | 12/1991 | Herring | 364/464.02 X |
| 5,200,903 | 4/1993 | Gilham | 364/464.02 |
| 5,340,965 | 8/1994 | Horbal et al. | 364/464.02 X |
| 5,369,401 | 11/1994 | Haines | 364/464.02 X |

FOREIGN PATENT DOCUMENTS

| | | |
|---|---|---|
| 0125526 | 11/1984 | European Pat. Off. . |
| 0172561 | 2/1986 | European Pat. Off. . |
| 0388843 | 9/1990 | European Pat. Off. . |
| 3712181 | 10/1987 | Germany . |
| 2173741 | 10/1986 | United Kingdom . |
| 2174039 | 10/1986 | United Kingdom . |
| 2208367 | 3/1989 | United Kingdom . |

*Primary Examiner*—Edward R. Cosimano
*Attorney, Agent, or Firm*—Shoemaker and Mattare Ltd.

[57] ABSTRACT

A franking machine is constructed such that only those electronic circuit elements carrying out functions for which there is a need for security are housed in a secure housing. Thus means for accounting and storing accounting data and for controlling a print head to print franking impressions is contained in the secure housing. Other elements commonly housed in the secure housing, such as keyboard and display are located exterior of the secured housing. Security for manual recredit operations is improved by securely operating the print head to print register information before and after recrediting.

9 Claims, 3 Drawing Sheets

FRANKING MACHINE

BACKGROUND OF THE INVENTION

This invention relates to franking machines and in particular to franking machines in which accounting and control functions are carried out by electronic circuits and printing of franking impressions is effected by an electronically controlled digital printing device, for example by a thermal transfer printer.

In known franking machines it is common for the machine to comprise a base unit and a postage metering unit mounted on the base unit. The base unit contains electrical power supplies for the franking machine and means for feeding mail items through the franking machine. The postage metering unit includes electronic circuits, commonly implemented by a microprocessor, to carry out accounting functions and to control various operations to be performed by the franking machine. A keyboard is provided to enable input to the microprocessor of function selecting signals and of data, for example selected values of postage charge. A display device is driven by the microprocessor to echo the input of the keyboard to enable a user to verify that the correct and intended input has been effected and also to display other information to enable the user to ascertain the status of the machine and to otherwise assist the user in using the machine. Non-volatile memory devices are provided to store accounting data relating to use of the machine in carrying out franking of mail items. It is usual for the memories to have a number of registers acting respectively as a descending register to store a value of credit currently available for use in franking mail items with postage charges, an ascending tote register to store an accumulated value of postage charge used in franking mail items, an items count register to store a count of the number of items franked by the machine and a high items register to store a count of the number of items franked with a value of postage charge greater than a predetermined value. The accounting data stored in the memories provides an accounting record of revenue to the postage authority by whom the franking machine is licensed to be used and also provides an accounting record of expenditure by the user in respect of postage charges for mail items franked by the machine and subsequently handled by the postal authority. Accordingly it is necessary that the accounting data is accurately generated and maintained. The postage metering unit also includes a printer for printing franking impressions on the mail items. The printer is controlled by the electronic circuits such that the printer prints an indication in the franking impression of the value of postage charge for which accounting has been carried out. When a value of postage charge is selected by the user, accounting circuits of the meter check the value of credit in the descending register available for use in franking and if there is sufficient credit, the descending register is decremented by the amount of the selected value of postage charge, the ascending register is incremented by the same selected value, the items count is incremented by unity and the printer is operated to print a franking impression, the franking impression including an indication of the selected value of postage charge.

If unauthorised access can be obtained to those parts of the postage metering unit utilised for carrying out accounting functions and for printing, such access could be used to tamper with operation of the accounting circuits or printer or to change data in the accounting records whereby postage charges could be applied fraudulently in franking impressions on mail items without correctly accounting for those charges in the accounting records of the postage metering unit. Accordingly the postage metering unit is contained in a secure housing sealed against unauthorised access. If the seal is broken the postal authority is alerted to unauthorised access to the postage metering unit having occurred. Access is permitted by authorised personnel only and after such authorised access the secure housing is resealed.

A problem arises if there is a failure of any of the components of the postage metering unit because in order to repair the unit, access to the interior of the secure housing is required and such access would expose the critical accounting and control circuits to the possibility of tampering. Accordingly repairs to the postage metering unit may be carried out only in a secure manner by these persons authorised by the postal authority and entrusted with ensuring that the integrity of the accounting records is retained in the course of carrying out the repairs.

SUMMARIES OF THE INVENTION

According to one aspect of the invention a franking machine comprises a non-secure base unit and a secure module releasably connected to said base unit; said secure module including a secure housing; a thermal print head mounted to the secure housing with thermal print elements of said thermal print head exterior to the housing; and said secure housing containing only electronic circuits required for carrying out accounting functions in relation to operation of the franking machine and for controlling energisation of the thermal print elements to print a franking impression and said secure module including communication means for input and output of electrical signals to and from said electronic circuits contained in said secure module.

According to a second aspect of the invention a franking machine includes:

a secure module comprising a secure housing containing electronic circuits for carrying out accounting functions and for maintaining account records relating to use of the franking machine in franking mail items; a communication port connected to the electronic circuits and extending to the exterior of said housing; and a printer controlled by the electronic circuits to print a franking impression including a value of postage charge, said printer having printing elements located exterior to the secure housing; and a non-secure base module including feed means to feed a mail item past the printer of the secure module and input means for input of a selected value of postage charge with which a mail item is to be franked and electronic control means responsive to input of said selected value to input signals via the communication port of the secure module to the electronic circuits to cause said electronic circuits to carry out an accounting operation in respect of said selected value and to operate the printer to print the franking impression including said selected value on a mail item fed by said feed means; and said secure module being removably mounted on said non-secure base module and said communication port being releasably electrically connected to said electronic control means.

According to a third aspect of the invention a franking machine includes a secure postage meter; said postage meter including a printer for printing franking impressions on mail items; electronic means operative in a franking operations to carry out accounting functions in respect of a credit value stored in a register of the postage meter and decrementing of said credit value by amounts of postage charge franked in franking impressions on mail items and to store the decremented value of credit in the register and to operate the printer to print a franking impression indicating the amount of postage charge on a mail item and said electronic means being operative in a recrediting operation in response to an input value of updating credit to increment said credit value by an amount equal to said input value of updating credit to an incremented value of credit and to store said incremented value of credit in the register and to operate said printer to print a record of said incremented value of credit.

According to a fourth aspect of the invention a franking machine includes a secure postage meter; said postage meter including a printer for printing franking impressions on mail items; electronic means operative in a franking operations to carry out accounting functions in respect of a credit value stored in a register of the postage meter and decrementing of said credit value by amounts of postage charge franked in franking impressions on mail items and to store the decremented value of credit in the register and to operate the printer to print a franking impression indicating the amount of postage charge on a mail item; and non-secure display means; a non-secure communication link between said display means and said electronic means in said secure postage meter;

said electronic means being operative in a recrediting operation in response to an input value of updating credit to increment said credit value by an amount equal to said input value of updating credit to an incremented value of credit and to store said incremented value of credit in the register and to operate said printer to print a record of said incremented value of credit.

BRIEF DESCRIPTION OF THE DRAWING

An embodiment of the invention will now be described by way of example with reference to the drawings in which.

DESCRIPTION OF THE PREFERRED EMBODIMENT

Figure 1:
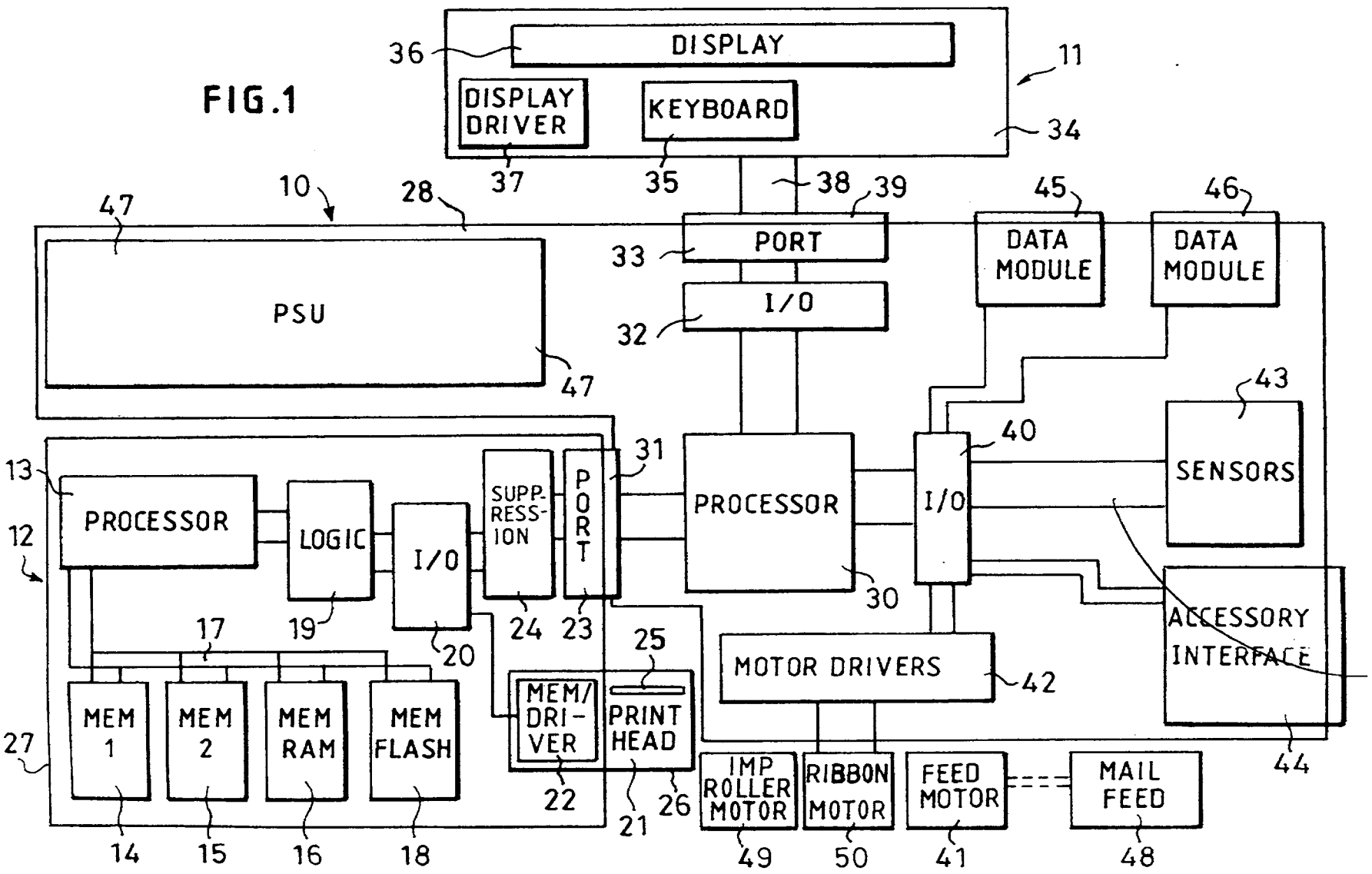
FIG. 1 is a block circuit diagram of a franking machine.
Figure 2:
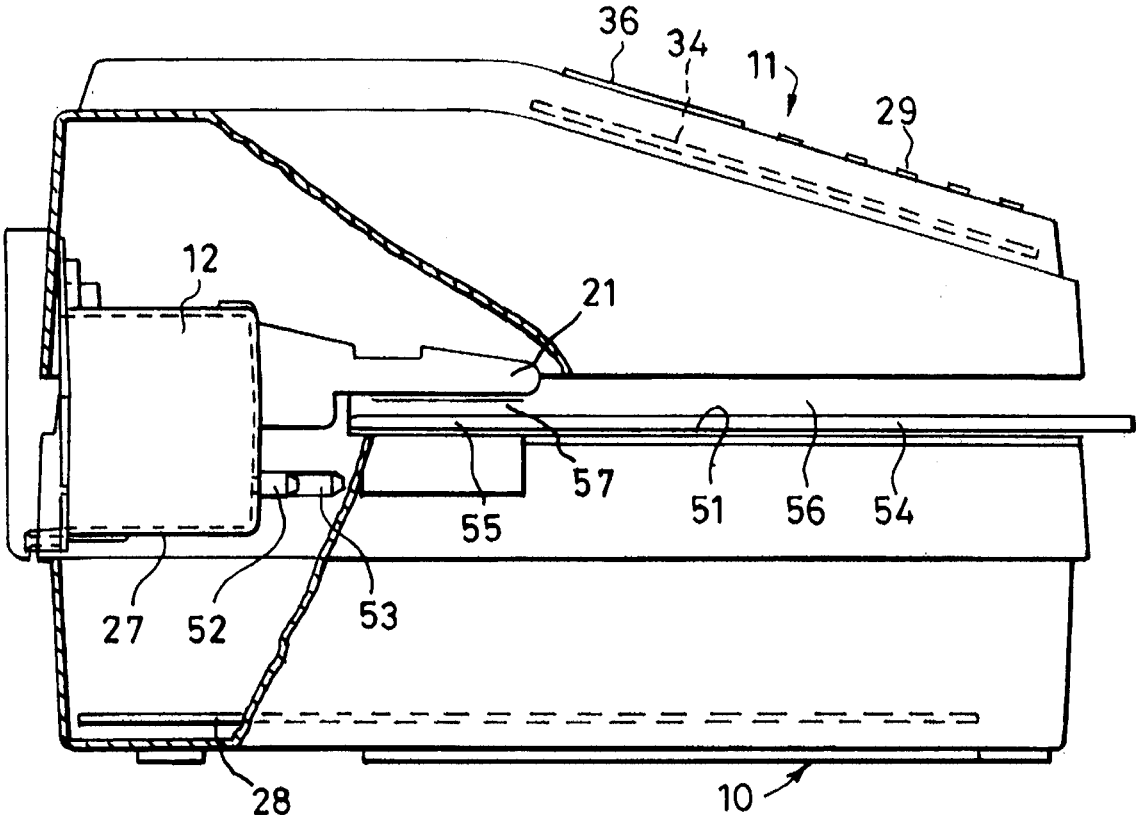
FIG. 2 is a cut-away side view of the franking machine.

Referring first to FIGS. 1 and 2 of the drawings, a franking machine includes a base unit 10, a keyboard and display unit 11 and a secure module 12.

The secure module 12 includes an electronic processor 13 to which non-volatile memories 14, 15 and a random access memory (RAM) 16 are connected by a bus 17. A read only flash memory 18 is also connected to the processor by the bus 17 and stores program routines under which the processor may be operated to carry out operations relating to accounting for value used in franking operations. The processor is connected via logic circuits 19 to an input/output device (I/O) 20. A print head 21 is controlled by print data signals output from the processor via the input/output device 20 to print head driver circuits 22 to print franking impressions and, if desired, slogans or other information on mail items. All input and output of signals to and from the secure module is via a port 23 connected via suppression circuits 24 to the I/O 20. The suppression circuits 24 are provided to prevent any excess voltages which may be applied to terminals of the port 23 from reaching and causing malfunction in the operation of the processor. Thus it will be appreciated that the secure module contains a print head to print franking impressions and all those circuit elements required to carry out accounting operations, to maintain and retain accounting records and to operate the print head. The secure module does not contain any elements for carrying out functions which are not directly related to the operations of accounting and operating the print head. Preferably the print head is a thermal print head and operation of the print head is utilised to transfer ink from a thermal transfer ink ribbon to the mail items. The thermal print head has a plurality of electrically resistive print elements selectively heatable by electric currents in dependence upon print data in buffer memory of the print head driver circuits. The thermal print elements are arranged in a line, indicated by reference numeral 25, and are formed as short portions of a track of electrically resistive material deposited on a substrate 26. The print head driver circuits 22 also are carried by the substrate 26. A mail item on which a franking impression is to be printed is fed past the line of thermal print elements and the thermal print elements are successively energised to cause heating thereof in such a manner as to transfer ink from the thermal ink transfer ribbon to the mail item to build up, line by line, the required franking impression on the mail item. Print data defining at least an invariable part of the franking impression is stored in compressed form in the flash memory 18 and is decompressed by the processor when the print data is required for operation of the print head. The RAM 16 is used as general purpose store when decompressing and otherwise handling the print data.

The elements of the secure module 12 are housed within a secure housing 27 so as to prevent access to the operational elements of the secure module other than by authorised persons. The substrate of the print head is mounted in the secure module such that the print head driver circuits 22 are located within the secure housing 27 and, in order to permit cooperation of the thermal print elements with a thermal transfer ink ribbon and mail items, the part of the substrate 26 carrying the line of thermal print elements protrudes from the secure housing. Thus substantially only the line of thermal print elements is located outside the secure housing 27. The construction of the print head is such that in practice the line of print elements is not accessible for purposes of tampering with operation of the print head. All those elements utilised for carrying out accounting functions and for controlling energisation of the line of print elements are located within the secure housing and unauthorised tampering therewith is prevented by the secure housing. The only access to the circuits in the secure module is via the port 23 and any attempt to cause malfunction of the circuits by application of excess voltages is prevented by the suppression circuits 24.

The base unit 10 of the franking machine includes a printed circuit board 28 carrying a further processor 30 operable to carry out functions of communication with the secure module 12 via a connector 31 connected to the port 23 of the secure module, to communicate with the display/keyboard unit 11 and to control feeding of mail items through the franking machine.

As shown in FIG. 1, the processor 30 communicates via an I/O 32 and port 33 with a keyboard/display unit 11. The keyboard/display unit includes a printed circuit board 34 carrying key contacts of keys 29 of a keyboard 35, a display device 36 and display driver circuits 37. The circuits of the keyboard/display module 11 are connected by means of a ribbon cable 38 terminating in a connector 39 connected to the port 33. The keyboard/display unit 11 is mounted on the base unit 10, the ribbon cable permitting the unit 11 to be removed from the base unit for servicing purposes without electrical disconnection therefrom.

The processor communicates via an I/O 40 with other devices on the base unit 10 to perform functions required in operation of the franking machine. A motor 41 for driving means 48 for feeding mail items past the print head, a motor 49 for raising and lowering an impression roller into and out of operative position relative to the print head and a motor 50 for driving a spool or reel for take-up of used thermal transfer ribbon are controlled by motor driver circuits 42 controlled by the processor 30 via the I/O 40. The processor receives, via the I/O 40, signals from sensors 43 arranged to sense mail items during the feeding thereof, to sense the feeding of thermal transfer ribbon and to sense the position of mechanical elements utilised for feeding the mail items and the thermal transfer ink ribbon. The processor 30 communicates via the I/O 40 with an accessory interface 44 by means of which accessories may be connected to the franking machine. For example, a weighscale may be connected to the interface for weighing of mail items prior to franking and for inputting to the franking machine a signal indicating the weight of the item to be franked. The accessory interface may also be utilised for the connection thereto of a memory module known as CREDIPAC or for connection of the franking machine via a telephone line to a remote credit resetting centre or at postal authority premises to a credit updating device for the purpose of updating credit stored in the descending register of the secure module. One or more data modules 45, 46 may be provided for input of data to the secure module. Such data may consist for example of print data defining advertising slogans desired to be print alongside the franking impression on mail items and postal rate information relating to values of postage charges for different postal services and for different weights of mail item.

A power supply unit 47 mounted in the base unit provides electrical power at required voltage levels to all the circuit elements of the base unit 10, the keyboard/display module 11 and the secure module 12.

Referring to FIG. 2, base unit 10 has a feed bed 51 for mail items. The secure module 12 is removably mounted on the base unit 10 and is aligned relative to the base unit by pegs 52 projecting from the secure housing 27 of the secure module and entered into bores 53 in the base unit 10. The secure module is so aligned relative to the feed bed 51 that the underside of the print head 21 extends from the secure housing over the feed bed and is spaced from the feed bed. The spacing of the print head from the feed bed is such as to permit passage of mail items 54 along the feed bed with an edge portion 55 of the mail items passing below the print head. A thermal transfer ink ribbon 57 is fed between the print head and the mail item. The ribbon has a layer of ink on one surface thereof opposed to the mail item. For clarity in the drawing, the ribbon is shown spaced from the print head and from the mail item. However in practice, as is well known in the thermal printing art, the surface of the edge portion 55 of the mail item is brought into contact with the ink layer in the vicinity of the thermal printing elements 25 of the print head and the rear of the ribbon is brought into heat transfer engagement with the thermal printing elements by raising of the impression roller into operative position. The unit 11 extends over the base unit 10 and forms with the feed bed 51 of the base unit 10 a slot 56 through which the mail item 54 is fed.

When a franking operation is required to be performed, the user presses a key 29 on the keyboard 35 to initiate a franking operation and the processor 30 responds to operation of the keyboard to send to the processor 13 of the secure module via the port 23 control signals to initiate the processor 13 to perform a franking operation under control of a program routine stored in the memory 18. The user also operates the keyboard to input a selected value of postage charge to be applied to a mail item. Signals representing this selected value are received by the processor 30 and communicated thereby to the processor 13. The processor 13 continues with the franking operation in which account data stored in the memories 14, 15 is updated to reflect the value of franking to be applied and the printer is operated to print a franking impression including a representation of the selected value of postage charge. The display 36 is operated by the processor 30 to echo inputs entered on the keyboard whereby the user is informed of the input actually made on the keyboard and to display information relating to status of the franking machine and other information to assist and prompt the user in operation of the franking machine.

In other operations carried out by the franking machine, for example updating the value of credit stored in the descending register of the secure module, the display is operated by the processor 30 to provide information relating to the credit updating operation. When credit value is updated by taking the franking machine to postal authority premises, postal authority personnel set the franking machine into 'post office mode' either by operating a key operated switch by entering a code number on the keyboard. A value of credit by which the credit value registered in the descending register is to be incremented is then entered on the keyboard. As a part of the recrediting operation the values of the contents of the registers of the secure module are read out and sent via the port to the processor 30 and the processor 30 sends corresponding display signals to the keyboard/display module 11 to operate the display 36 to display these values. In each recrediting of the descending register of the franking machine, the value of the contents of the descending register both before and after the recrediting is displayed by the display 36. Thus it can be seen if the value of the contents of the descending register has been correctly incremented by an amount equal to the entered value of updating credit. As described hereinbefore, the display device 36 and signals to control operation of the display device are located in a non-secure part of the franking machine and hence it is possible that a person with fraudulent intent could tamper with the non-secure circuits such as to cause the display device to provide a display of false information during a recredit operation by postal authority personnel. For example, when the descending register is read out after the value of credit registered thereby has been incremented by the entered updating value, the processor 30 could be caused fraudulently to operate the display 36 to display the value of credit prior to recrediting. As a result the postal authority person would be mislead into thinking that the intended recrediting had not been successful and as a result would repeat the recrediting operation. If this occurred two or more amounts of updating credit would be entered into the descending register while the customer would be charged for only one amount of credit by the postal authority. This possibility of fraud arises only in respect of manual recrediting where postal authority personnel utilise the information displayed by the display 36 to ascertain values of contents of the registers of the secure module. Methods of recrediting in which the information displayed by the display 36 is not utilised to ascertain successful recrediting of the descending register do not give rise to this possibility of fraud. For example when recrediting using a CREDIPAC transportable memory module, U.S. Pat. No.

4,757,532, transfer of credit from the memory module can be effected only once and when recrediting from a remote recrediting centre, U.S. Pat. Nos. 4,907,271 and 5,077,792, such as in the system known as CREDIFON, communication between the secure module of the franking machine and the remote centre is effected by messages which are encrypted and, or alternatively, are encoded to ensure that the franking machine and remote recrediting centre respond only to genuine information messages.

Figure 3:
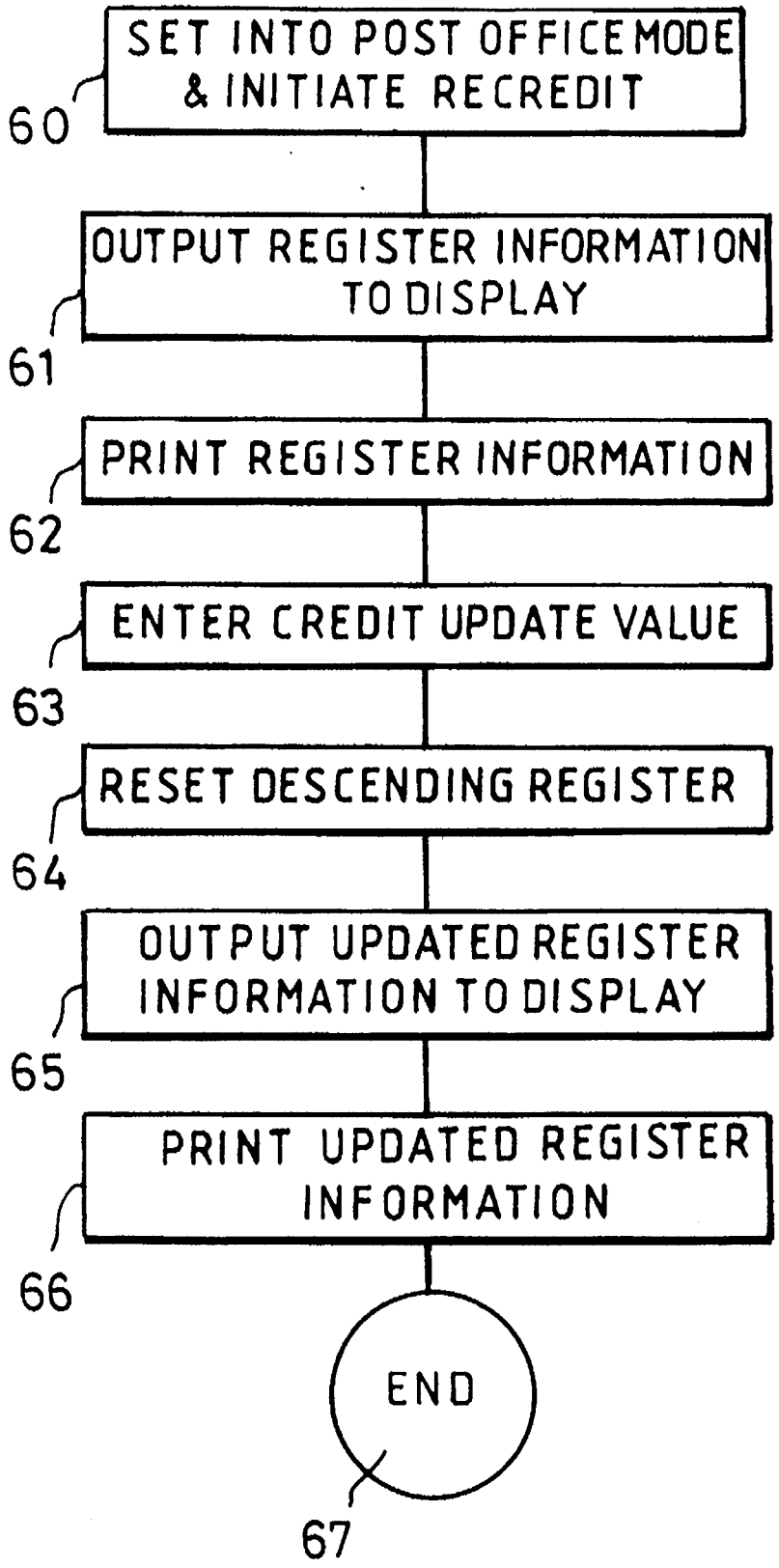
FIG. 3 is a flow chart of a recredit operation for the franking machine.

Accordingly when carrying out manual recrediting of the descending register, the secure module is operated so as to utilise the secure print head 21 to print out a record of the values of the contents of the descending register and, if desired, of any other registers of the secure module. The print head is operable only by the processor 13 and circuits securely contained within the secure housing of the secure module and hence tampering such as to cause printing of false information is not possible. As shown in the flow chart of FIG. 3, after setting the franking machine into post office mode and initiating a recredit operation (step 60), the processor 13 reads the descending register, and if desired other registers also, and outputs register information (step 61) to the processor 30. The processor 30 outputs signals to the display 36 to display the register information. The microprocessor 13 also outputs print data to the print head 21 to cause the print head to print the register information (step 62). The value of credit update is input on the keyboard (step 63) and the descending register is reset (step 64) by the microprocessor 13 to reflect the incrementing of the credit in the descending register. The microprocessor 13 outputs the updated register information to the microprocessor 30 for display by the display device 36 (step 65) and also causes the print head to print the updated register information (step 66). The printing of register information by the print head (steps 62, 66) may be in addition to or instead of displaying the register information by the display 36 (steps 61, 65). The print out of register information subsequent to recrediting can be compared with the information displayed prior to recrediting in respect of register information. Preferably the display is caused to display a prompt message requesting the operator to insert a record form in the mail item feed. Then the printer is operated by the processor 13 to print a record on the form of the amount of credit registered in the descending register both before and after recrediting and the amount can be compared to ascertain if the recredit is successful. If the register information is both displayed and printed, a comparison may be made between the displayed and printed information to determine if tampering has occurred. It will be appreciated that the printing of the register information is carried out automatically under the control of the processor 13 operating under a recredit program routine. After printing of the updated register information the recredit operation terminates (67).

It will be appreciated that the secure module 12 includes only those elements required in respect of carrying out accounting functions and operation of the printer. All other circuit elements for initiating operation of the secure module to carry out a required function such as franking a mail item or updating credit stored in the secure module and for input of data such as a required value of postage charge are located externally of the secure module. Thus whereas in known franking machines the keyboard and display are a part of the secure postage meter, in the present construction of franking machine these elements are located externally of the secure housing of the secure module and communicate with the circuits of the secure module via the port 23 and I/O 20. This is advantageous in that only those parts of the franking machine for which there is a need for security are located within the secure housing and all other parts are located externally of the housing. Consequently it is only when a fault arises in respect of the secure circuits in the module 12 than it becomes necessary to obtain access to the interior of the secure housing. Faults arising in the keyboard and display and other parts of the franking machine do not require access to the secure housing and hence these parts may be repaired in a non-secure manner by any competent engineer without the need for authorisation by the postal authority.

I claim:

1. A franking machine including:

a secure module comprising a secure housing containing electronic circuits for carrying out accounting functions and for maintaining account records relating to use of the franking machine in franking mail items; a communication port connected to the electronic circuits and extending to the exterior of said housing; and a printer controlled by the electronic circuits to print a franking impression including a value of postage charge, said printer having printing elements located exterior to the secure housing; and a non-secure base module including feed means to feed a mail item past the printer of the secure module and input means for input of a selected value of postage charge with which a mail item is to be franked and electronic control means responsive to input of said selected value to input signals via the communication port of the secure module to the electronic circuits to cause said electronic circuits to carry out an accounting operation in respect of said selected value and to operate the printer to print the franking impression including said selected value on a mail item fed by said feed means; and said secure module being removably mounted on said non-secure base module and said communication port being releasably electrically connected to said electronic control means.

2. A franking machine as claimed in claim 1 wherein the printer comprises a thermal print head including a plurality of thermal print elements carried by a substrate; print head driver circuits carried by said substrate and connected to said thermal print elements; and wherein the substrate is mounted to the secure housing such that said thermal print elements are located exterior to said secure housing and said print head driver circuits are located within the secure housing.

3. A franking machine as claimed in claim 1 including display means to display information to a user of the franking machine wherein said display means and the input means are constructed as a module mounted on the non-secure base unit.

4. A franking machine as claimed in claim 1 wherein the electronic means is operative in a recrediting operation in response to an input value of updating credit to increment said credit value by an amount equal to said input value of updating credit to an incremented value of credit and to store said incremented value of credit in the register and to operate said printer to print a record of said incremented value of credit.

5. A franking machine as claimed in claim 4 wherein the electronic means is operative in a recrediting operation to print a record of said value of credit stored in the register and of said incremented value of credit.

6. A franking machine including a secure postage meter; said postage meter including a printer for printing franking impressions on mail items; electronic means operative in a franking operations to carry out accounting functions in respect of a credit value stored in a register of the postage meter and decrementing of said credit value by amounts of postage charge franked in franking impressions on mail items and to store the decremented value of credit in the register and to operate the printer to print a franking impression indicating the amount of postage charge on a mail item and said electronic means being operative in a recrediting operation in response to an input value of updating credit to increment said credit value by an amount equal to said input value of updating credit to an incremented value of credit and to store said incremented value of credit in the register and to operate said printer to print a record of said incremented value of credit.

7. A franking machine as claimed in claim 6 wherein the electronic means is operative in a recrediting operation to print a record of said value of credit stored in the register and of said incremented value of credit.

8. A franking machine including a secure postage meter; said postage meter including a printer for printing franking impressions on mail items; electronic means operative in a franking operations to carry out accounting functions in respect of a credit value stored in a register of the postage meter and decrementing of said credit value by amounts of postage charge franked in franking impressions on mail items and to store the decremented value of credit in the register and to operate the printer to print a franking impression indicating the amount of postage charge on a mail item; and non-secure display means; a non-secure communication link between said display means and said electronic means in said secure postage meter;

said electronic means being operative in a recrediting operation in response to an input value of updating credit to increment said credit value by an amount equal to said input value of updating credit to an incremented value of credit and to store said incremented value of credit in the register and to operate said printer to print a record of said incremented value of credit.

9. A franking machine as claimed in claim 8 wherein the electronic means is operative in a recrediting operation to print a record of said value of credit stored in the register and of said incremented value of credit.

* * * * *